US008210801B2

(12) United States Patent
Ballard, Jr. et al.

(10) Patent No.: US 8,210,801 B2
(45) Date of Patent: Jul. 3, 2012

(54) SYSTEMS AND METHODS OF REDUCING HEAT LOSS FROM A GAS TURBINE DURING SHUTDOWN

(75) Inventors: Henry G. Ballard, Jr., Easley, SC (US); Ian David Wilson, Simpsonville, SC (US); Stephen Christopher Chieco, Simpsonville, SC (US); Andrew Ray Kneeland, Simpsonville, SC (US); Bradley James Miller, Simpsonville, SC (US); Kenneth David Black, Travelers Rest, SC (US); Raymond Goetze, Greenville, SC (US)

(73) Assignee: General Electric Company, Schenectady, NY (US)

( * ) Notice: Subject to any disclaimer, the term of this patent is extended or adjusted under 35 U.S.C. 154(b) by 788 days.

(21) Appl. No.: 12/362,086

(22) Filed: Jan. 29, 2009

(65) Prior Publication Data

US 2010/0189551 A1 Jul. 29, 2010

(51) Int. Cl.
*F02C 6/08* (2006.01)

(52) U.S. Cl. ..... 415/175; 415/115; 60/39.83; 60/782

(58) Field of Classification Search ..... 415/175, 415/39.07, 39.29; 60/772, 782, 728, 262, 60/226.1, 806

See application file for complete search history.

(56) References Cited

U.S. PATENT DOCUMENTS

| | | | | | |
|---|---|---|---|---|---|
| 3,892,499 | A * | 7/1975 | Strub | 415/179 |
| 4,513,567 | A * | 4/1985 | Deveau et al. | 60/782 |
| 5,272,879 | A * | 12/1993 | Wiggs | 60/676 |
| 5,605,437 | A | 2/1997 | Meylan | |
| 5,667,358 | A | 9/1997 | Gaul | |
| 5,689,948 | A * | 11/1997 | Frutschi | 60/774 |
| 6,050,079 | A * | 4/2000 | Durgin et al. | 60/782 |
| 6,146,090 | A * | 11/2000 | Schmidt | 415/47 |
| 6,318,066 | B1 * | 11/2001 | Skowronski | 60/776 |
| 7,269,955 | B2 * | 9/2007 | Albers et al. | 60/782 |
| 7,422,414 | B2 * | 9/2008 | Fujii et al. | 415/1 |
| 8,015,826 | B2 * | 9/2011 | Myers et al. | 60/785 |
| 2007/0137213 | A1 * | 6/2007 | Rickert et al. | 60/782 |

* cited by examiner

*Primary Examiner* — Steven Loke
*Assistant Examiner* — David Goodwin
(74) *Attorney, Agent, or Firm* — Sutherland Asbill & Brennan LLP

(57) ABSTRACT

A method operates a gas turbine that includes a compressor section, a turbine section and an extraction cooling system. The method includes monitoring an operation of the gas turbine, directing a cooling air flow through the extraction cooling system from the compressor section to the turbine section in response to normal operation of the gas turbine, and directing a warming air flow through the extraction cooling system to the compressor section and the turbine section in response to shutdown of the gas turbine.

29 Claims, 7 Drawing Sheets

SYSTEMS AND METHODS OF REDUCING HEAT LOSS FROM A GAS TURBINE DURING SHUTDOWN

TECHNICAL FIELD

The present disclosure generally relates to gas turbines, and more particularly relates to systems and methods of reducing heat loss from a gas turbine during shutdown.

BACKGROUND OF THE INVENTION

A typical gas turbine generally includes a compressor, at least one combustor, and a turbine. The compressor supplies compressed air to the combustor. The combustor combusts the compressed air with fuel to generate a heated gas. The heated gas is expanded through the turbine to generate useful work.

Specifically, the gas turbine may include a stator case that defines an exterior of the machine, and a rotor may extend longitudinally through the stator case on the interior of the machine. Within the turbine, a number of turbine blades may be positioned about a disc associated with the rotor, and energy may be transferred to the turbine blades as the heated gas expands. The resulting rotation of the rotor may be transferred to a generator or other load, such that useful work results. The rotation of the rotor also may be employed in the compressor to create the compressed air. For this purpose, a number of compressor blades may be positioned about the rotor in the compressor.

During operation of the gas turbine, the various components of the turbine expand and contract. For example, thermal expansion may occur due to the relatively high temperature associated with turbine operation, and mechanical expansion may occur due to centripetal forces associated with rotation of the interior components.

One problem with gas turbines is that the various components expand and contract at different and varying rates. The varying rates result from differences among the components in material, geometry, location, and purpose. To accommodate for the discrepancy in expansion and contraction rates, a clearance is designed into the gas turbine between the tips of the blades and shroud. The clearance reduces the risk of turbine damage by permitting the blades to expand without contacting the shroud. However, the clearance substantially reduces the efficiency of the turbine by permitting a portion of the heated gas to escape past the blades without performing useful work, which wastes energy that would otherwise be available for extraction. A similar clearance may be designed into the compressor between the compressor blades and the compressor case, which may permit air to escape past the compressor blades without compressing.

The size of the clearance may vary over stages in an operational cycle of the gas turbine, due to varying thermal and mechanical conditions in the gas turbine during these stages. One example operational cycle of a gas turbine is schematically illustrated in FIG. 1. As shown, the gas turbine is typically initiated from a "cold start" by increasing the rotor speed and subsequently drawing a load, which has the illustrated effect on the clearance between the tips of the turbine blades and the turbine shroud. The gas turbine may then be shutdown for a brief period, such as to correct a known issue. During shutdown, the load may be removed, the rotor speed may be reduced, and the components may begin contracting and cooling. Subsequently, a "hot restart" may occur, wherein the gas turbine is restarted before the components return to cold build conditions.

During these operational stages, the clearance may be at a relative minimum at various "pinch points". For example, the turbine may experience pinch points at full speed, no load (FSNL) and at full speed, full load (FSFL) before the turbine achieves steady state (SS FSFL). The clearances at each of these pinch points may be different during the cold start cycle and the hot restart cycle, with a minimum clearance occurring during the hot restart cycle at full speed, full load. For this reason, the gas turbine is designed with cold build clearances selected to accommodate the limiting point at hot restart full speed, full load, which results in the turbine running with inefficiently large clearances at steady state. In other words, the cold build clearances are selected in view of preventing tip rub during the hot restart cycle and not in view of achieving maximum efficiency during cold start and steady state operations.

The tight clearances observed during the hot restart cycle may be due in part to the gas turbine cooling relatively faster on the exterior (stator) than the interior (rotor) during shutdown. For example, the interior components of the turbine may remain warm, while the stator case may cool and contract toward the interior. The cooling of the stator case may be exacerbated by a cooling air flow traveling along the length of the gas turbine during shutdown. More specifically, the gas turbine may have a series of inlet guide vanes positioned along the compressor, which permit air to enter the gas turbine for compression and subsequent expansion. Because these inlet guide vanes may remain open during shutdown, air may continue to pass into the compressor. The air may be pulled along the length of the gas turbine with continued rotation of the rotor, which is required due to its mass. The resulting draft may further cool the stator case during shutdown, thereby resulting in tighter clearances on hot restart.

What the art needs are systems and methods for reducing differences in thermal response between stator and rotor components during gas turbine operating cycles, particularly the shutdown cycle. The art further needs such systems and methods, which may be implemented on existing gas turbines without adding a substantial number of parts or substantially redesigning the hot gas path.

BRIEF DESCRIPTION OF THE INVENTION

A method operates a gas turbine that includes a compressor section, a turbine section and an extraction cooling system. The method includes monitoring an operation of the gas turbine, directing a cooling air flow through the extraction cooling system from the compressor section to the turbine section in response to normal operation of the gas turbine, and directing a warming air flow through the extraction cooling system to the compressor section and the turbine section in response to shutdown of the gas turbine.

Other systems, devices, methods, features, and advantages of the disclosed systems and methods of reducing heat loss and or thermal differences from a gas turbine will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION OF THE INVENTION

Described below are systems and methods of reducing heat loss from a stator case of a gas turbine during a shutdown cycle. By reducing heat loss from the exterior at shutdown, the systems and methods may increase clearances between the blade tips and the stator case during a hot restart cycle. Thus, avoiding tip rub during hot restart may become less of a limiting factor in the gas turbine design, such that cold build clearances may be adjusted to increase efficiency during steady state operation. In other words, by heating the stator case during the shutdown cycle, larger clearances may be achieved during the hot restart cycle, which may permit tightening the clearances during the steady state cycle to increase efficiency.

Figure 1:
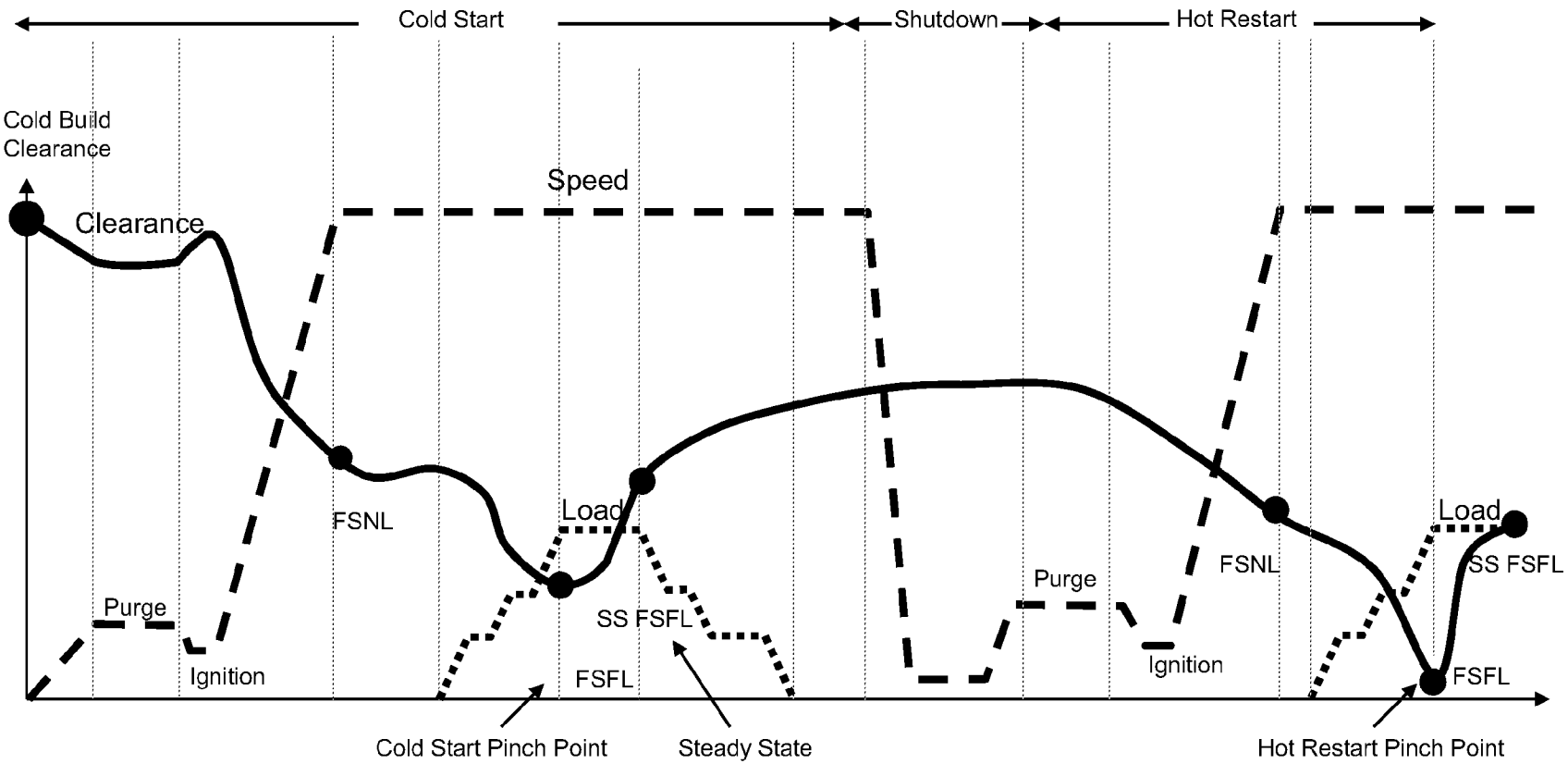
FIG. 1 is a graph of illustrating the relationship among clearance, rotor speed, and load for a prior art gas turbine.

These effects may be illustrated with reference to FIG. 1. By reducing heat loss from the stator case during the shutdown cycle, the systems and methods may move the hot restart pinch point upward in FIG. 1. Thus, the gas turbine may be redesigned to move all points downward, including the steady state points. Downward movement of the steady state points represents tighter clearances during steady state cycles, which improves efficiency by reducing the volume of gas escaping around the turbine blades.

The systems and methods may employ existing components of the gas turbine and may require relatively few modifications to the hot gas path, which may decrease design, implementation, and maintenance costs for existing gas turbine models and may permit retrofitting existing gas turbine units with relative ease. The systems and methods may reduce heat loss from the stator case about both the turbine and the compressor as described below, although one or the other may not be so treated as desired.

Figure 2:
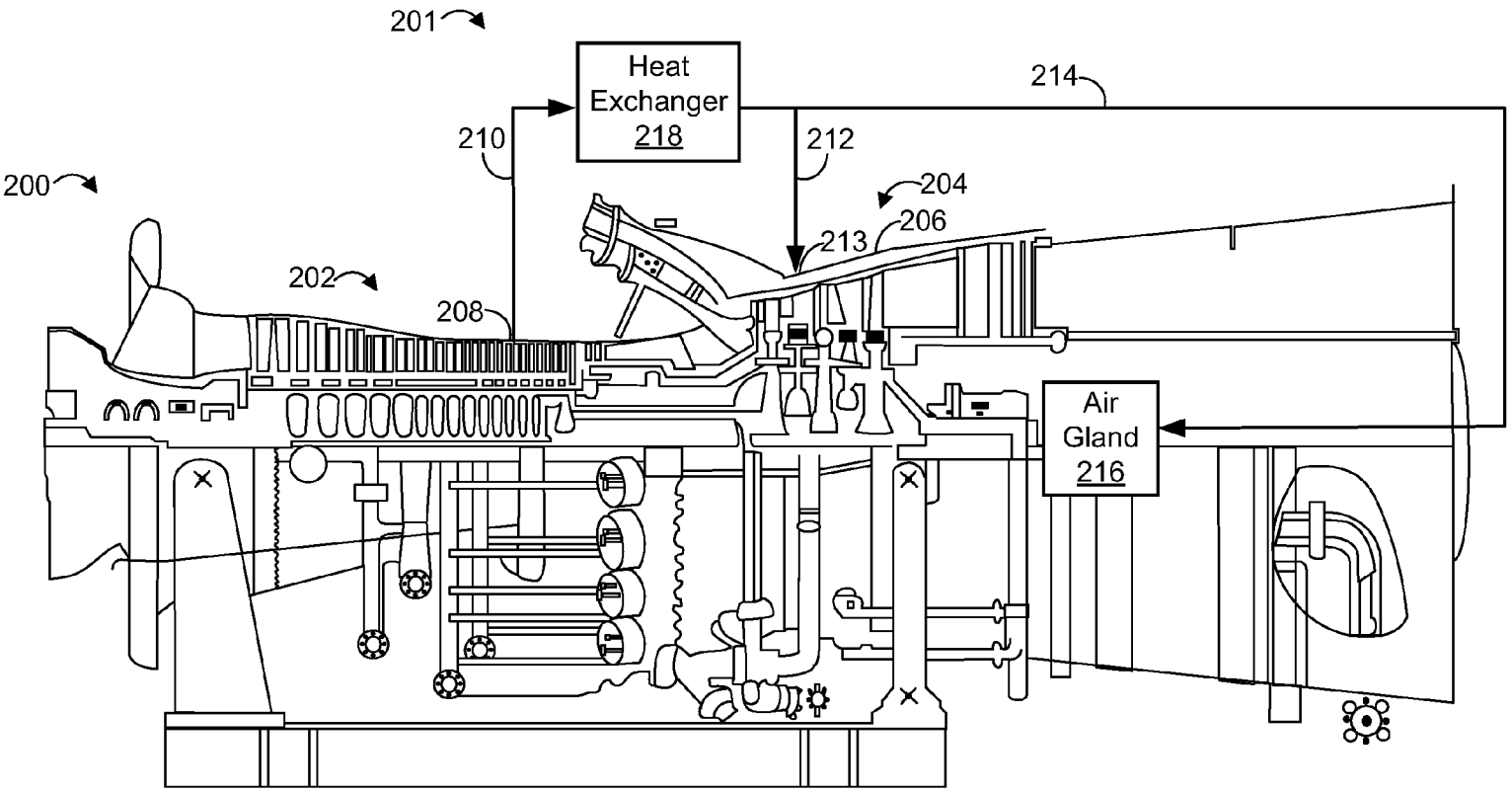
FIG. 2 (PRIOR ART)
FIG. 2 is a cross-sectional view of a prior art gas turbine, illustrating an embodiment of an extraction cooling system.

FIG. 2 is a cross-sectional view of a prior art gas turbine 200, illustrating an embodiment of an extraction cooling system 201. The extraction cooling system 201 may direct cool a turbine section 204 of the gas turbine 200 with air from a compressor section 202. The extraction cooling system 201 is designed to alleviate the relatively high temperatures achieved in the turbine section 204 during normal operation. The high temperatures may be reduced by extracting air from the compressor section 202 and applying this air to exterior and interior components in the turbine section 204, such as nozzles, shrouds, turbine rotor, and buckets. As shown, the air is extracted from an extraction port 208 in the compressor section 202 into an extraction line 210. The extraction line 210 may be in fluid communication with an exterior component supply line 212, which may direct air onto the stator case 206 in the turbine section 204 through an exterior component cooling port 213. Thereby, the turbine shroud and nozzles may be cooled. The extraction line 210 may also be in fluid communication with the interior component supply line 214, which may direct air to an air gland 216 on an interior of the gas turbine 200. Thereby, the rotor and buckets may be cooled. In embodiments, a heat exchanger 218 may be positioned between the extraction line 210 and the supply lines 212, 214. The heat exchanger 218 may reduce the temperature of the extracted air before the air is employed for cooling purposes.

The description above pertains to one embodiment of an extraction cooling system, and others are possible. In fact, the design of extraction cooling systems is a well known art. A range of designs employ various combinations of the above-described components, or other components, are possible. For example, a number of extraction circuits may be provided, in which case air may be extracted from multiple extraction points into multiple cooling ports. Also, the heat exchanger 218 may be omitted in some cases, or additional heat exchangers 218 may be provided. Further, the extraction system may only cool the stator case 206, in which case the interior supply line 214 and the air gland 216 may be omitted.

Figure 3:
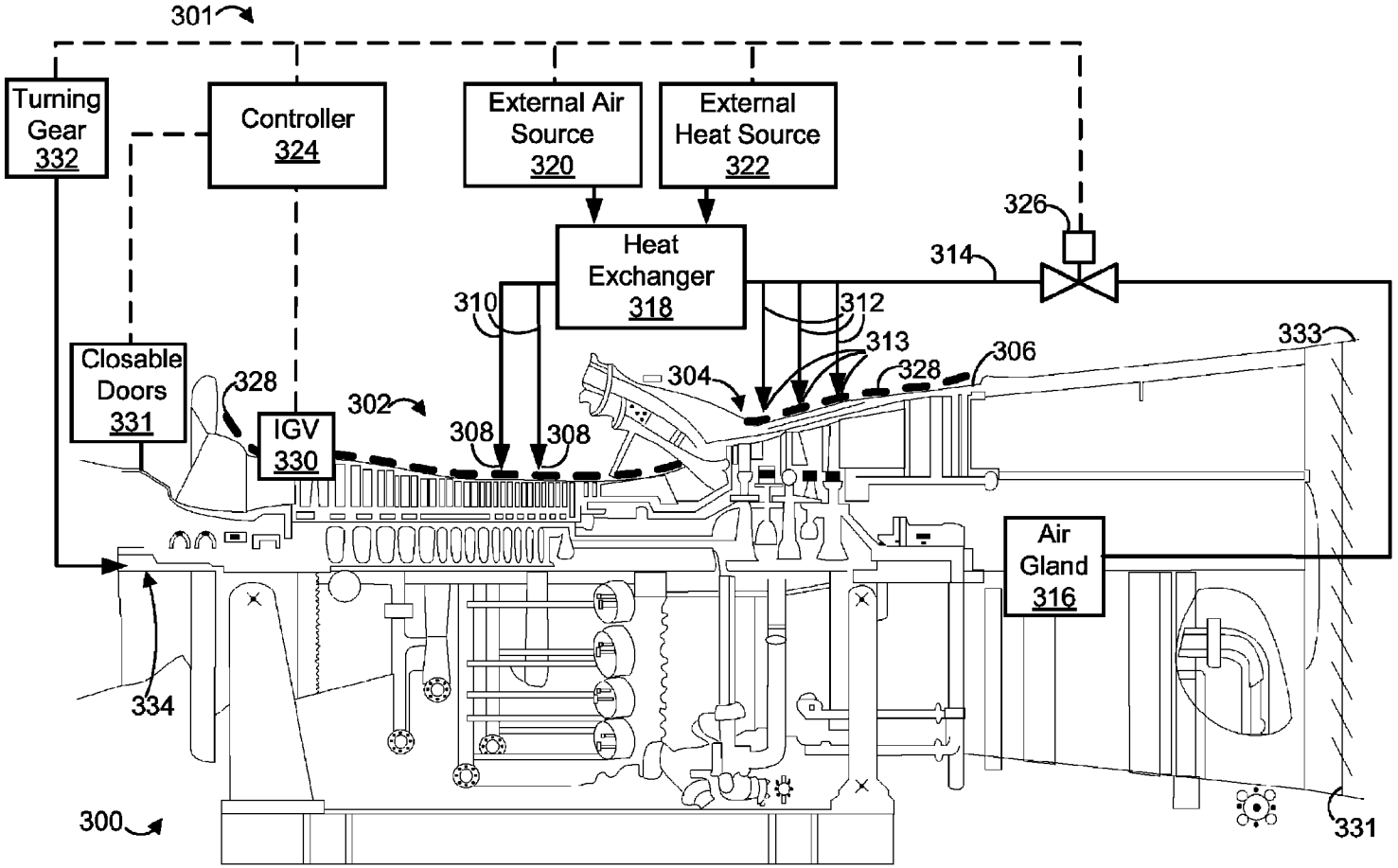
FIG. 3 is a cross-sectional view of a gas turbine, illustrating an embodiment of a system of reducing heat loss from a stator case of the gas turbine during shutdown.

FIG. 3 is a cross-sectional view of an embodiment of a gas turbine 300, illustrating a system 301 for reducing heat loss from the gas turbine 300 during a shutdown cycle. As shown, the system 301 generally includes an external air source 320, an external heat source 322, a heat exchanger 318, a number of compressor supply lines 310 and compressor supply ports 308, a number of turbine supply lines 312 and turbine supply ports 313, and a controller 324.

The external air source 320 may have any configuration configured for driving air into the heat exchanger 318 at adequate pressure. For example, the external air source 320 may be a blower that directs ambient air into the heat exchanger 318, or a source of pressurized air. The heat exchanger 318 may be in fluid communication with both the external air source 320 and the supply lines 310, 312. The heat exchanger 318 may also be in thermal communication with the external heat source 322, which may be an electrical heat source, a gas heat source, a geothermal heat source, a solar heat source, or a biomass heat source, among others or combinations thereof. For example, the external heat source 322 may be an external burner. The supply lines 310, 312 may be in fluid communication with both the heat exchanger 318 and the stator case 306. For example, the compressor supply lines 310 may in fluid communication with the stator case 306 about the compressor section 302, such as through compressor supply ports 308 about the compressor case. Similarly, the turbine supply lines 312 may be in fluid communication with the stator case 306 about the turbine section 304, such as through turbine supply ports 313 about the turbine section. It should be noted that any number of supply lines 310, 312 may be used. Further, the heat exchanger 318 may include an internal heat source, in which case the external heat source 322 may be omitted.

The controller 324 may monitor an operational cycle of the gas turbine 300. For example, the controller 324 may know when the gas turbine 300 enters a shutdown cycle. The shutdown cycle may be triggered for a variety of reasons, such as in response to a trip condition or at the initiation by the operator. Regardless of the reason, the controller 324 may be operable to initiate a flow of heated air to the stator case 306 in response to the gas turbine 300 experiencing a shutdown.

More specifically, the controller 324 may cause the external heat source 322 to heat the heat exchanger 318. The controller 324 may also cause the external air source 320 to drive air through the heat exchanger 318 into the supply lines 310, 312. Within the heat exchanger 318, the air may be warmed, and the supply lines 310, 312 may direct the warmed air onto the stator case 306. Thereby, the stator case 306 may be warmed to reduce heat loss associated with shutdown of the gas turbine 300. The controller 324 may not operate the external heat source 322 or the external air source 320 unless and until a shutdown occurs, which may reduce the cost of operating the system 301. It also should be noted that the controller 324 may operate the system 301 in response to conditions other than a shutdown of the gas turbine 300, which may permit altering the contraction or expansion rate of the stator case 306 to achieve desired clearances during other cycles of operation.

In embodiments, the system 301 may be implemented in conjunction with a cooling system of the gas turbine 300, such as the extraction cooling system described above with reference to FIG. 2. For example, each compressor supply port and line 308, 310 may be one of the extraction ports and lines used to extract cooling air from the compressor section 302 during turbine operation. Similarly, each turbine supply port and line 312, 313 may be one of the exterior component supply ports and lines used to supply cooling air to the exterior of the turbine section 304 during turbine operation. Also, the heat exchanger 318 may be the heat exchanger that reduces the temperature of the cooling air before applying it to the turbine section 304.

When the gas turbine 300 is operated, cooling air may be directed through the lines 310, 312 from the compressor section 302 to the turbine section 304 as described above with reference to FIG. 2. Once the gas turbine 300 is shutdown, warmed air may be directed through the lines 310, 312 to the compressor section 302 and the turbine section 304, as described above with reference to FIG. 3. Thus, cooling may be achieved during operation, and heat loss may be reduced during shutdown. Also, the cooling air flow to the turbine section 304 may be interrupted during shutdown, as the system 301 repurposes the extraction cooling system for warming purposes.

It should be noted that the direction of travel of air through the compressor lines 310 may be reversed during shutdown, so that air flows to the compressor section 302 instead of from the compressor section 302. Further, the function of the heat exchanger 318 may be reversed during shutdown, so that the heat exchanger 318 warms air instead of cooling air. Also, the source of air may be altered during shutdown, such that air flows from the external air source 320 instead of from the compressor section 302.

In embodiments in which the system 301 uses common components with an extraction cooling system, implementing and maintaining the system 301 may be relatively inexpensive. It also may be relatively easy and inexpensive to retrofit an existing gas turbine 300 with the system 301 in the field, as a substantial portion of the system 301 may already be in place on the gas turbine 300. For example, retrofitting the gas turbine 300 may entail associating the controller 324, the external air source 320, and the external heat source 322 with the heat exchanger 318. The heat exchanger 318 may also be provided during retrofitting, depending on whether the existing extraction cooling system includes one.

As mentioned above, the existing extraction cooling system may also include an interior component supply line 314 in communication with an air gland 316 on an interior of the gas turbine 300. In such cases, the system 301 may further include an interior component supply valve 326 positioned on the interior component supply line 326. The interior component supply valve 326 may selectively permit or prevent air flow through the interior component supply line 314 to the air gland 315. The controller 324 may be operated to close the interior component supply valve 326 in response to a shutdown cycle, so that the heated air is not directed toward the interior of the gas turbine 300. The interior of the gas turbine 300 may stay warm without the application of additional heat. In embodiments, the interior component supply valve 326 may be an existing component of the extraction cooling system. In such cases, retrofitting the gas turbine 300 with the system 301 may entail associating the controller 324 with the existing valve to permit closure on shutdown. In other embodiments, the interior component supply valve 326 may not be present, in which case the valve may be added during retrofitting.

The system 301 is generally described above as providing warmed air to both the compressor and turbine sections 302, 304. However, one of these sections 302, 304 may not be warmed or may be only partially warmed in some embodiments. Thus, one or more of the supply lines 312, 314 may be omitted. Also, valves may be provided on the supply lines 312, 314 for selectively providing or preventing the flow of warmed air as desired.

In embodiments, the system 301 may further include an insulation layer 328 positioned about the stator case 306 of the gas turbine 300. The insulation layer 328 may further reduce heat loss from the stator case 306 during the shutdown cycle. The insulation layer 328 may cover any portion of the stator case 306 in whole or in part. For example, the stator case 306 may be insulated about the turbine section 304 but not the compressor section 302, depending on the embodiment. The insulation layer 328 may be provided with a new gas turbine 300, retrofitted onto an existing gas turbine 300 in the field, or omitted completely.

In embodiments, the system 301 may further include a number of closable inlet guide vanes 330 and a number of closable doors 331. The closable inlet guide vanes 330 may be positioned along the stator case 306 in the compressor section 302. The closable doors 331 may be positioned in inlet and exhaust plenums 333 located in the compressor section 302 and the turbine section 304, respectively. The closable doors 331 are shown schematically for the purposes of illustration. The closable inlet guide vanes 330 may be actuated between open and closed positions, unlike conventional guide vanes that cannot be closed. For example, the closable inlet guide vanes 330 may be completely closed. Similarly, the closable doors 331 may be actuated between open and closed positions. The controller 324 may be operated to close one or more of the closable inlet guide vanes 330 and/or the closable doors 331 in response to the gas turbine 300 experiencing a shutdown. Closing the closable inlet guide vanes 330 and/or the closable doors 331 may reduce the flow of a cooling air draft through the gas turbine 300, which may assist in reducing heat loss from the stator case 306. As a result, the stator case 306 may not transfer heat to the passing air draft. Further, the stator case 306 may better receive heat from the interior components. However, one or more of the closable inlet guide vanes 330 and the closable doors 331 may not be provided in all embodiments, such as in embodiments in which the system 301 is retrofitted onto an existing gas turbine 300.

In embodiments, the system 301 may further include turning gear 332 associated with the rotor 334. The controller 324 may be operated to control the speed of the turning gear 332 during shutdown. For example, the turning gear 332 may cause the rotor 334 to continue rotating when the rotor 334 would otherwise cease rotation, which may reduce bowing or sagging that would otherwise disturb the balance of the rotor 334. In embodiments, the turning gear 332 may rotate the rotor 334 at a speed selected to limit or prevent stratification of any air remaining in the gas turbine 300 without substantially creating a draft. Thus, temperature variations along a vertical cross-section of the gas turbine 300 may be reduced without exacerbating the temperature variation along the horizontal length of the gas turbine 300. In other words, heat loss from the stator case 306 may be further reduced without a thermal plume developing on the interior of the gas turbine 300. For example, the turning gear 332 may rotate the rotor 334 at a speed greater than about six revolutions per minute. In embodiments in which the system 301 is employed with reference to an existing gas turbine design or unit, implementing the system 301 may entail associating the controller 324 with existing turning gear 332, which may already be present.

In embodiments, the system 301 may be implemented in conjunction with a combined cycle power plant. As is known in the art, the combined cycle power plant may include both a gas turbine and a steam turbine. The combined cycle power plant may also include an auxiliary boiler. During start-up operations, the auxiliary boiler may provide heat to a heat recovery steam generator to generate steam for expansion in the steam turbine. In such embodiments, the steam from the auxiliary boiler also may be employed as the external heat source 322 in the system 301, in which case the controller 324 may be operable to selectively permit or prevent passage of the steam from the auxiliary boiler to the heat exchanger 318. For example, the controller 324 may control a valve positioned on a supply line from the auxiliary boiler to the heat exchanger 318.

Figure 4:
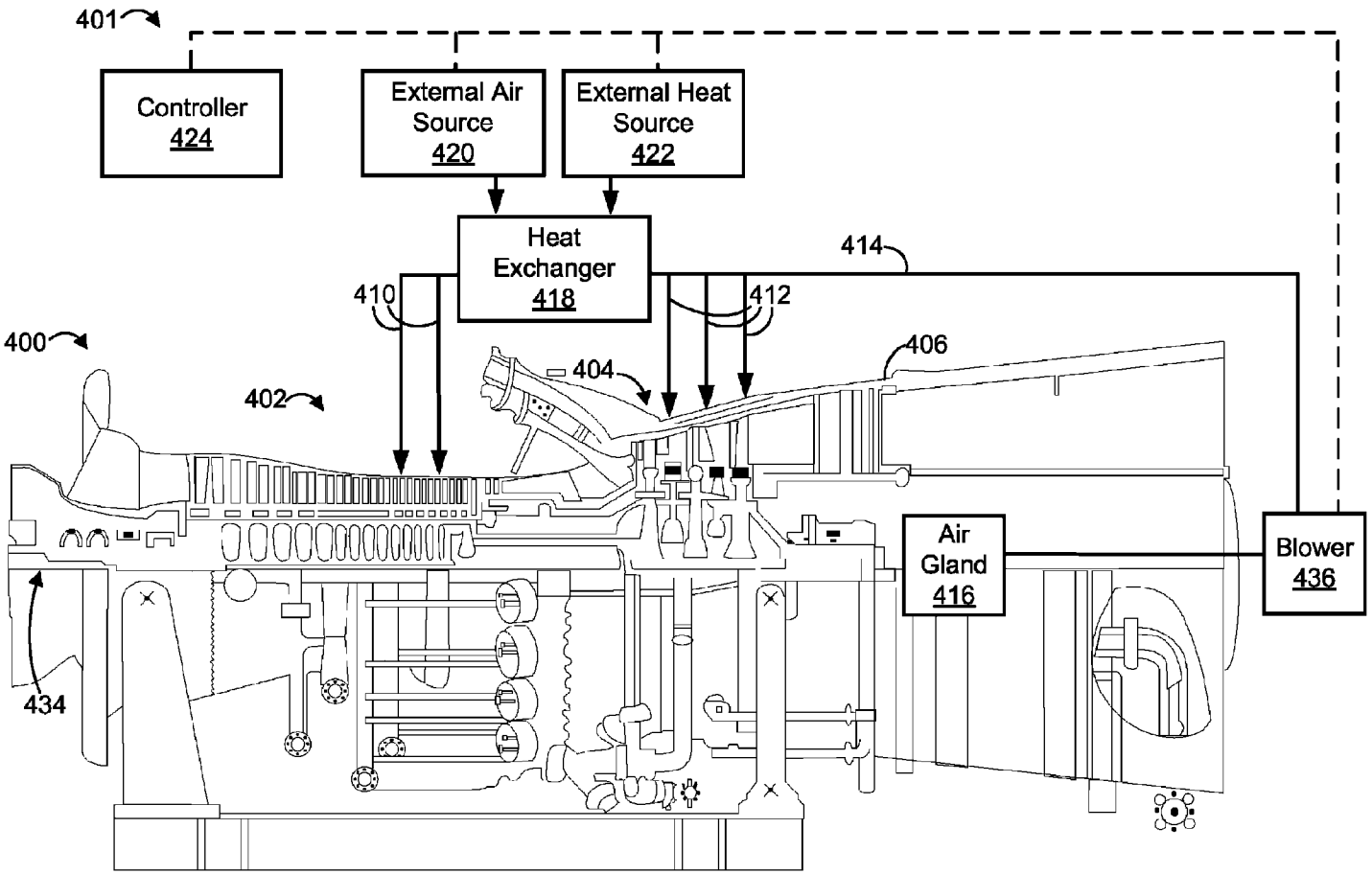
FIG. 4 is a cross-sectional view of a gas turbine, illustrating another embodiment of a system of reducing heat loss from a stator case of the gas turbine during shutdown.

FIG. 4 is a cross-sectional view of a gas turbine 400, illustrating another embodiment of a system 401 of reducing heat loss from a stator case 406 of the gas turbine 400. The system 401 may be generally similar to the system 301 described above with reference to FIG. 3. For example, the system 401 may include a number of supply lines 410, 412 and ports, a heat exchanger 418, external air and heat sources 420, 422, and a controller 424. Additionally, the system 401 may include a blower 436 and a rotor extraction line 414.

The rotor extraction line 414 may be in fluid communication with interior components of the gas turbine 400. The supply lines 410, 412 may be in fluid communication with the rotor extraction line 414 and the stator case 406. For example, the compressor supply lines 410 may in fluid communication with the stator case 406 about the compressor section 402 and the turbine supply lines 412 may be in fluid communication with the stator case 406 about the turbine section 404.

The blower 436 may be positioned on the rotor extraction line 414. The controller 424 may monitor an operational cycle of the gas turbine 400 and may initiate the blower 436 in response to the gas turbine 400 entering a shutdown cycle. Thereby, the blower 436 may direct a flow of heated air from the interior of the gas turbine 400 to the stator case 406 during shutdown. The flow may remove heat from the interior components of the gas turbine 400, such as the rotor 434, for application to the stator case 406 through the supply lines 410, 412. Thus, the rotor 434 may be cooled with the stator case 406 may be heated, which may increase the clearance.

In embodiments, the system 401 may be implemented in conjunction with an extraction cooling system of the gas turbine 400 as generally described above. For example, the supply lines 410, 412 may be the existing lines described above. Also, the rotor extraction line 414 may be the existing line that supplies cooling air to the rotor 434 during operation of the gas turbine 400 to cool the rotor buckets. In such embodiments, cooling air may be directed through the lines 410, 412, 414 from the compressor section 402 when the gas turbine 400 is operated, as described above with reference to FIG. 2. Once the gas turbine 400 is shutdown, warmed air may be directed from the interior of the rotor 434 through lines 414, 412, 410 to the stator case 406. It should be noted that the direction of travel of air through the rotor extraction line 414 is reversed during shutdown, so that air flows from the interior of the gas turbine 400 instead of to the interior of the gas turbine 400. It also should be noted that one or more of the heat exchanger 418, the external air source 420, an external heat source 422 may be omitted in such embodiments. If present, these components generally may function as described above with reference to FIG. 3.

Figure 5:
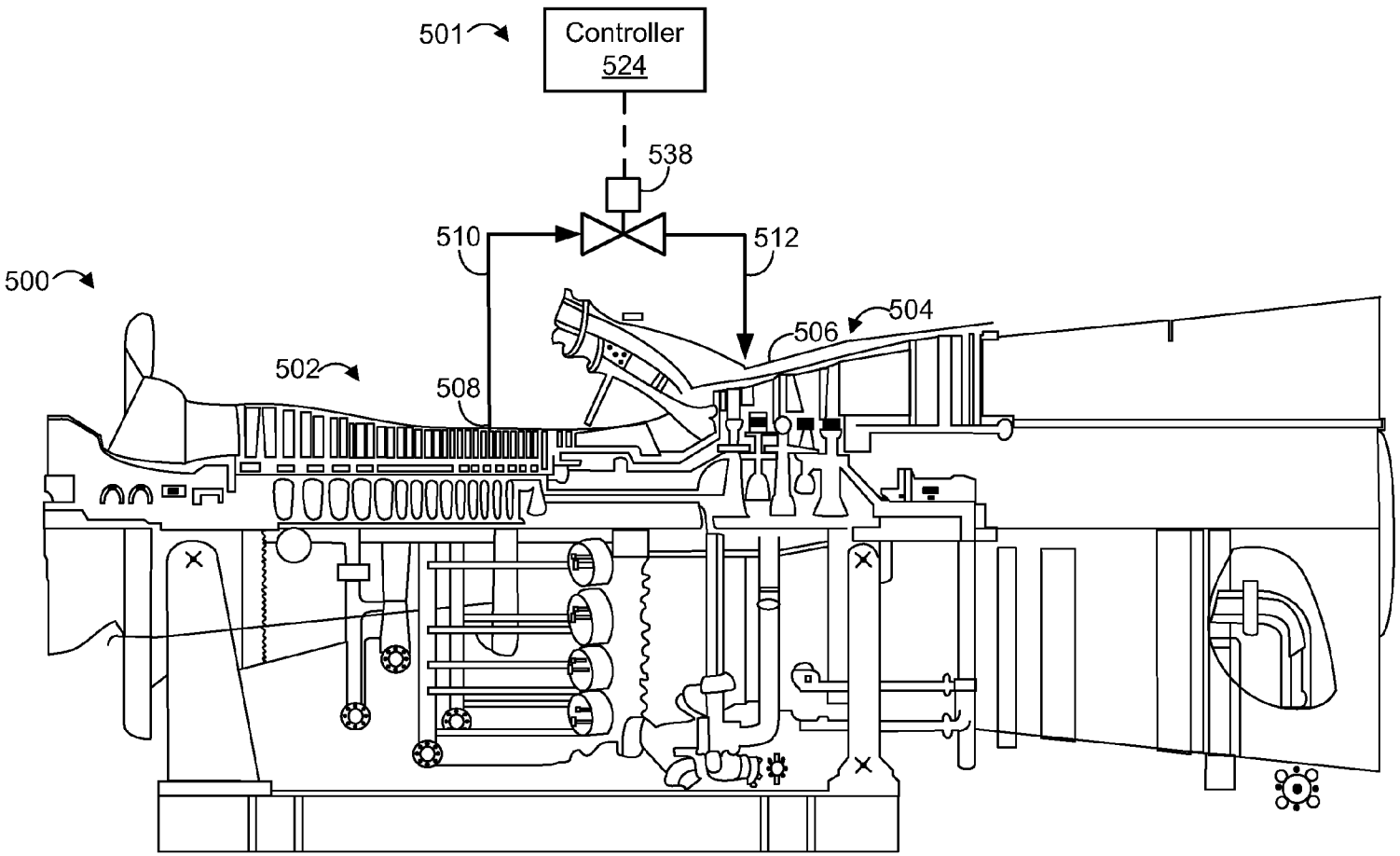
FIG. 5 is a cross-sectional view of a gas turbine, illustrating a further embodiment of a system of reducing heat loss from a stator case of the gas turbine during shutdown.

FIG. 5 is a cross-sectional view of a gas turbine 500, illustrating another embodiment of a system 501 of reducing heat loss from a stator case 506 of the gas turbine 500 during a shutdown cycle. As shown, the system 501 generally includes an embodiment of an extraction cooling system, similar to the one shown and described above with reference to FIG. 2. Specifically, the system 501 may include an extraction port 508 in the compressor section 502 in fluid communication with an extraction line 510, which may lead to an exterior component supply line 512 in fluid communication with a stator case 506 in the turbine section 504. The system 501 may also include a controller 524 and a valve 538 positioned on either the extraction line 510 or the exterior component supply line 512. The valve 538 may selectively permit or prevent cooling air from traveling from the compressor section 502 to the turbine section 504 through the lines 510, 512. The controller 524 may be operable to close the valve 538 in response to a shutdown of the gas turbine 500, which may prevent extracted air from traveling to the turbine section 504 for cooling purposes. Thus, the turbine section 504 may experience reduced heat loss due to removal of the cooling air flow from the compressor section 502. Only one extraction circuit is shown for example, although any configuration of lines and ports could be employed. In such cases, one or more valves 538 may be appropriately positioned and controlled by the controller 524 to prevent the cooling flow during shutdown.

Figure 6:
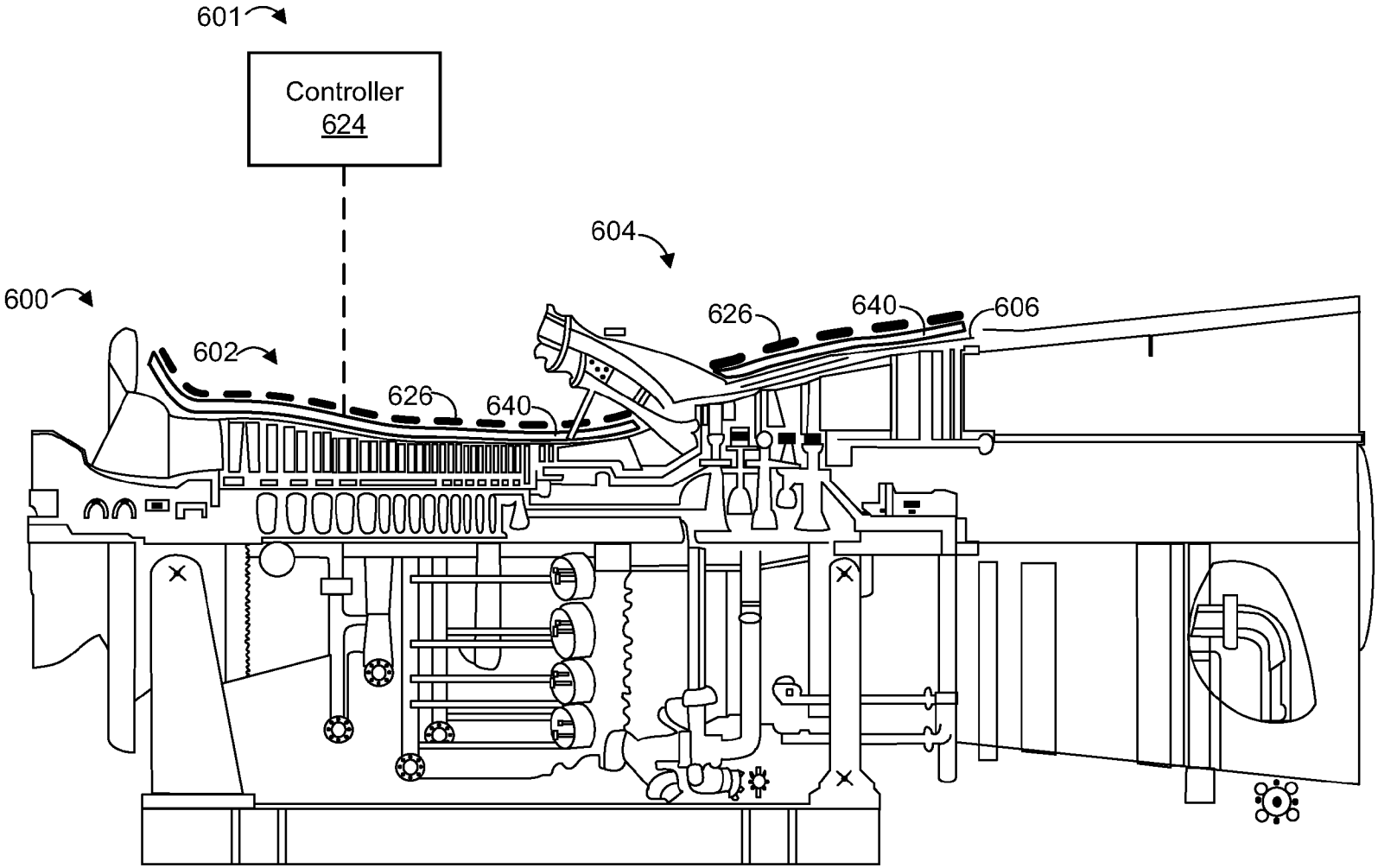
FIG. 6 is a cross-sectional view of a gas turbine, illustrating an additional embodiment of a system of reducing heat loss from a stator case of the gas turbine during shutdown.

FIG. 6 is a cross-sectional view of a gas turbine 600, illustrating another embodiment of a system 601 of reducing heat loss from a stator case 606 of the gas turbine 600 during a shutdown cycle. The system 601 may generally include a heated cover 640 associated with a controller 624. The heated cover 640 may be positioned about the stator case 606 of the gas turbine 600. The heated cover 640 may cover any portion of the stator case 606 in whole or in part. For example, the heated cover 640 may extend about the stator case 306 along one or both of the compressor section 602 and the turbine section 604, depending on the embodiment.

The heated cover 640 may function in a variety of manners, depending on the embodiment. For example, heated air may be circulated through the heated cover 640. Also, heated steam may be circulated through the heated cover 640, such as in embodiments in which the gas turbine is part of a combined cycle power plant as described above. Other heating devices may also be employed, such as electric or gas heating elements, among others.

The controller 624 may cause the heated cover 640 to begin heating, to stop heating, or to achieve a predetermined temperature in response to the operational cycle of the gas turbine 600. For example, the controller 624 may initiate the heated cover 640 during the shutdown cycle to reduce heat loss from the stator case 606. Also, the controller 624 may initiate the heated cover 640 before a cold start cycle to preheat the stator case 606. The controller 624 also may prevent the heated cover 640 from heating during certain cycles, such as when the gas turbine 600 is operational. For example, the controller 624 may stop the heated cover 640 from heating during a hot restart cycle.

In some cases, the controller 624 may maintain the heated cover 640 at a predetermined temperature. The predetermined temperature may be selected to achieve desired clearances by controlling a temperature of the stator case 606.

In embodiments, the controller 624 may variably control the heated cover 640 according to location or position on the gas turbine 600. For example, the controller 624 may start, stop, or vary the temperature of the heated cover 640 at certain locations on the stator case 606 to reduce or eliminate areas where the clearance is relatively tight or where the stator 606 case is relatively misshapen. Such areas of tight clearance may result due to variations in geometry and temperature about the circumference of the stator case 606. For example, the stator case 606 may include non-uniform features such as bolted flanges and false flanges, as well as other circumferential variations, may cause the stator case 606 to be out of round. By heating the circumferential locations on the stator case 606 that have the smallest clearances, known pinch points may be reduced.

In embodiments, the system 601 may further include an insulation layer 628 as described above with reference to FIG. 3. The heated cover 640 may be positioned between the insulation layer 628 and the stator case 606, although the insulation layer 628 is not necessary and may be omitted.

Figure 7:
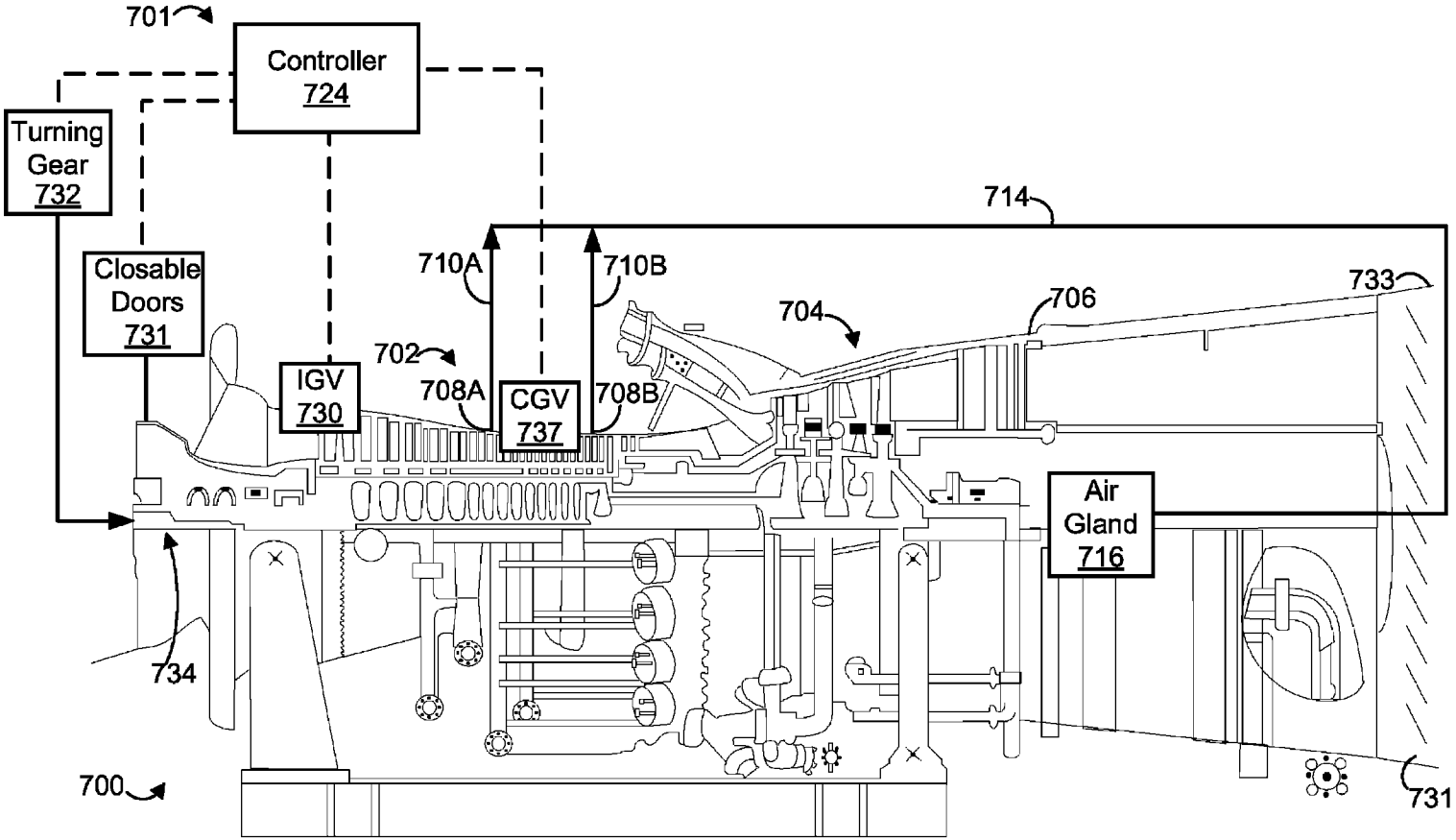
FIG. 7 is a cross-sectional view of a gas turbine, illustrating an additional embodiment of a system of reducing heat loss from a stator case of the gas turbine during shutdown.

FIG. 7 is a cross-sectional view of a gas turbine 700, illustrating another embodiment of a system 701 of reducing heat loss from a stator case 706 of the gas turbine 700. The system 701 may include components of the systems described above. For example, the system 701 may include ports 708 and lines 710 in communication with a stator casing 706 about the compressor section 702, and a line 714 in communication with an air gland 716 on an interior of the gas turbine 700. Some or all of these components may be components of an extraction cooling system, as described above. The system 701 may also include a number of closable guide vanes 730, a number of closable doors 731, and a controller 724 operable to open and close these guide vanes 730 and doors 731 to reduce heat loss, as described above. Additionally, the system 701 may include additional closable guide vanes 737 positioned immediately downstream from one of the ports 708 in the compressor section 702, and turning gear 732 operable to control rotation of the rotor 734. In response to a shutdown of the gas turbine 700, the controller 724 may be operable to close the additional closable guide vanes 737 while causing the turning gear 732 to rotate the rotor 734 at a selected speed. The rotor 734 may be rotated at a speed selected to create compressed air in the compressor section 702. The closable guide vane 737, when closed, may prevent the compressed air from flowing downstream of the closable guide vane 737, such that the compressed air may be prevented from flowing into the turbine section 704 or any downstream extraction ports 708 and lines 710, shown on FIG. 7 as ports 708B and line 710B. Thus, an air pressure may be created in the compressor section 702, which may drive a cooling flow from the compressor section 702 through any upstream extraction ports 708 and lines 710, shown on FIG. 7 as ports 708A and lines 710A. The cooling flow may be directed through the lines 714 to the air gland 716 for the purpose of cooling the rotor 734. In some cases, the controller 724 also may close the guide vanes 730 while the turning gear 732 rotates the rotor 734 at a relatively low speed, which may reduce heat loss from the stator case 706 due to reduced flow through the gas turbine 700 while preventing air stratification in the turbine section 704, as described above. Thus, the thermal difference between the stator casing 706 and the rotor 734 may be further reduced. It is noted that the system 701 may be combined with the system 501 shown in FIG. 5 in some embodiments.

The systems and methods described above may be modified and combined in a variety of manners. For example, the closable inlet guide vanes may be implemented with reference to any of the embodiments described above. As another example, the turning gear that reduces the rotation of the rotor during shutdown may be implemented with reference to any of the embodiments. Further modifications and combinations may be envisioned by a person of skill upon reading the disclosure above.

The systems and method described above may permit increasing the efficiency of a gas turbine by reducing the running clearances between the blade tips and the stator case during hot restart or other pinch points in the engine cycle. By reducing heat loss from the stator case during a shutdown cycle, the gas turbine may maintain acceptable clearances during a hot restart cycle. Thus, pinch points during the hot restart cycle may become less of a limiting factor in the design of the gas turbine, and cold build clearances may be adjusted to match clearances optimized for steady state operation. The optimization may occur at the time the gas turbine is initially designed. Alternatively, an existing gas turbine may be retrofitted with the system for reducing heat loss, and the corresponding components may be optimized subsequently to reduce the running clearance observed during steady state operation. The systems and methods may require relatively few, if any, alterations to the hot gas path, which may reduce design and implementation costs. Further, existing gas turbines may be retrofitted with embodiments of the systems and methods with relatively low cost and effort.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

At least the following is claimed:

1. A method of operating a gas turbine, the gas turbine comprising a compressor section, a turbine section and an extraction cooling system, the method comprising:

monitoring an operation of the gas turbine;

directing a cooling air flow through the extraction cooling system from the compressor section to the turbine section in response to normal operation of the gas turbine; and directing a warming air flow through the extraction cooling system to the compressor section and the turbine section in response to shutdown of the gas turbine.

2. The method of claim 1, wherein directing a warming air flow through the extraction cooling system comprises directing a warming air flow onto a portion of a stator case about the turbine section.

3. The method of claim 1, wherein directing a warming air flow through the extraction cooling system comprises directing a warming air flow onto a portion of a stator case about the compressor section.

4. The method of claim 1, wherein directing a warming air flow through the extraction cooling system comprises interrupting a cooling air flow through the extraction cooling system.

5. The method of claim 4, wherein directing a warming air flow through an extraction cooling system comprises directing a warming air flow through a portion of the extraction cooling system in a reverse direction.

6. The method of claim 1, further comprising closing an inlet guide vane in the compressor section in response to the shutdown.

7. The method of claim 1, further comprising interrupting an air flow through the extraction cooling system to an interior of the gas turbine in response to the shutdown.

8. The method of claim 1, further comprising directing a warming air flow through the extraction cooling system from the interior of the gas turbine to a stator case in response to the shutdown.

9. A system for reducing heat loss from a stator case of a gas turbine during a shutdown cycle, the system comprising:

a heat exchanger;

an external air source operable to direct air into the heat exchanger;

an external heat source operable to supply heat to the heat exchanger;

at least one supply line in fluid communication with the heat exchanger and the stator case; and a controller operable to trigger the external air source in response to the shutdown cycle.

10. The system of claim 9, wherein the external air source comprises a blower adapted to direct ambient air into the heat exchanger.

11. The system of claim 9, wherein the external heat source comprises one or more of the following: an electrical heat source, a gas heat source, a geothermal heat source, a solar heat source, a biomass heat source, an external burner, and a flow of steam from a boiler.

12. The system of claim 9, wherein the at least one supply line comprises a plurality of compressor supply lines in fluid communication with the stator case adjacent to a compressor.

13. The system of claim 9, wherein the at least one supply line comprises a plurality of turbine supply lines in fluid communication with the stator case adjacent to the turbine.

14. The system of claim 9, further comprising a closable passage, wherein:

the closable passage comprises one or more of the following: a closeable guide vane in the compressor section, a closable door in an inlet plenum to the compressor section, and a closable door in an exhaust plenum from the turbine section; and the controller is further operable to close the closable passage in response to the shutdown cycle.

15. The system of claim 9, further comprising an insulation layer positioned about at least a portion of the stator case.

16. The system of claim 9, further comprising turning gear operable to rotate a rotor of the gas turbine, wherein the controller is further operable to cause the turning gear to rotate the rotor at a relatively low speed, wherein the relatively low speed is selected to substantially reduce temperature variations along a vertical cross-section of the gas turbine.

17. The system of claim 9, the gas turbine comprising an existing interior component supply line that permits air flow to interior components of the gas turbine, the system further comprising:

an interior component supply valve positioned on the interior component supply line, wherein the controller is further operable to close the interior component supply valve in response to the shutdown cycle.

18. The system of claim 9, further comprising:

an interior component supply line in fluid communication with interior components of the gas turbine and the stator case; and a blower positioned on the interior component supply line, wherein the controller is further operable to initiate the blower in response to the shutdown cycle to direct heated air from the interior components to the stator case.

19. A system for reducing heat loss from a stator case of a gas turbine during a shutdown cycle, the system comprising:

an extraction cooling system configured to direct a flow of cooled air from a compressor to the stator case about a turbine section;

at least one valve operable to selectively permit or prevent the flow of cooled air to the stator case about the turbine section; and a controller operable to actuate the valve in response to the shutdown cycle to prevent the flow of cooled air.

20. The system of claim 19, further comprising an inlet guide vane movable between opened and closed positions, wherein the controller is further operable to close the inlet guide vane in response to the shutdown cycle.

21. The system of claim 19, further comprising turning gear associated with a rotor, wherein:

the closable guide vane is positioned adjacent to a port of the extraction cooling system in the compressor; and the controller is further operable cause the turning gear to rotate the rotor at a speed selected to drive air through the extraction cooling system.

22. A system for reducing heat loss from a stator case of a gas turbine during a shutdown cycle, the system comprising:

a heated cover positioned about at least a portion of the stator case operable to expand and contract at least a portion of the stator case; and a controller operable to cause the heated cover to heat in response to the shutdown cycle.

23. The system of claim 22, wherein the controller is further operable to cause the heated cover to stop heating in response to a hot restart cycle.

24. The system of claim 22, further comprising an insulation layer positioned over at least a portion of the heated cover.

25. The system of claim 22, wherein the controller is further operable to variably control the heated cover according to position on the stator case.

26. A system for reducing heat loss from a stator case of a gas turbine during shutdown, the system comprising:

an inlet guide vane movable between opened and closed positions;

a controller operable to close the inlet guide vane in response to the shutdown; and an extraction cooling system, wherein the controller is further operable to interrupt the extraction cooling system in response to the shutdown to prevent a cooling air flow from a compressor to a portion of the stator casing.

27. The system of claim 26, further comprising turning gear operable to control a rotation of a rotor, wherein the controller is further operable to cause the turning gear to rotate the rotor at a relatively low speed, wherein the relatively low speed is selected to substantially reduce temperature variations along a vertical cross-section of the gas turbine.

28. The system of claim 26, further comprising an external heat source and an external air source associated with the extraction cooling system, wherein the controller is further operable to repurpose the extraction cooling system to direct a warming air flow onto the stator case during shutdown.

29. The system of claim 26, further comprising at least one door, the door movable between opened and closed positions, the door positioned in either an inlet plenum into the compressor section or an exhaust plenum from the turbine section, wherein the controller is further operable to close the door in response to the shutdown.

* * * * *